US007824230B1

(12) United States Patent
Ho

(10) Patent No.: US 7,824,230 B1
(45) Date of Patent: Nov. 2, 2010

(54) AUDIO PLUG

(75) Inventor: Hsin-Tsung Ho, Tu-Cheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/616,785

(22) Filed: Nov. 12, 2009

(51) Int. Cl.
*H01R 24/04* (2006.01)

(52) U.S. Cl. ..... 439/669

(58) Field of Classification Search ..... 439/669, 439/668

See application file for complete search history.

(56) References Cited

U.S. PATENT DOCUMENTS 4,275,946 A * 6/1981 Manina et al. ..... 439/188
4,938,717 A * 7/1990 Lau ..... 439/669
5,261,839 A * 11/1993 Franks, Jr. ..... 439/669
6,394,852 B1 * 5/2002 Huang ..... 439/669
7,553,195 B2 * 6/2009 Matsumoto et al. ..... 439/669
7,618,294 B1 * 11/2009 Lin et al. ..... 439/669
7,699,665 B1 * 4/2010 Yin ..... 439/669
2002/0025728 A1 * 2/2002 D'Addario et al. ..... 439/668
2008/0160835 A1 * 7/2008 Chen et al. ..... 439/668
2009/0311915 A1 * 12/2009 Stiehl ..... 439/669
2010/0112871 A1 * 5/2010 Yin ..... 439/669

* cited by examiner

*Primary Examiner*—T C Patel
*Assistant Examiner*—Vladimir Imas

(57) ABSTRACT

An audio plug includes an insulating housing of substantial column shape, a plurality of cylindrical audio contacts made up of a tip contact, a first contact and second contact, a fixing element with two indention areas symmetrically formed at an outer surface thereof and spaced away from each other, and two isolated grounding contacts of arc shape. Each of the grounding contacts has an arc contact slice received in the indention area of the fixing element, conforming to an outer periphery of the fixing element. The tip contact, the first contact, the second contact, and the fixing element with the grounding contacts attached thereto are arranged in turn and molded to the insulating housing in once, forming as a single piece.

5 Claims, 3 Drawing Sheets

AUDIO PLUG

BACKGROUND OF THE INVENTION

1. Field of the Invention

The present invention relates to an audio plug, and particularly to an audio plug having an excellent transmitting effect in use.

2. The Related Art

Audio plugs and jacks are frequently and widely used in consumer audio and telecommunication products. The audio plug, which is familiar to most people, typically comprises an insulating housing of substantially column shape, and a series of electrically isolated cylindrical contacts mounted to the insulating housing, ending in a "tip" contact. The contacts are electrically connected with terminals of the jack to transmit electrical signals, when the audio plug is inserted into the jack, thereby achieving multiple functions. Generally speaking, the audio plug is provided with one cylindrical grounding contact, serving as the common grounding end of the contacts. However, in process of the audio plug being inserted into the jack to transmit the electrical signals, plural circuits formed between the audio plug and the jack use only one grounding end, which makes the transmitted signals intermix with much mixed wave. As a result, the sound heard by the user has noise, or even being distorted. So, it is desirable and necessary to design a structure to reduce the mixed wave in transmitting process.

SUMMARY OF THE INVENTION

Accordingly, an object of the present invention is to provide an audio plug. The audio plug includes an insulating housing of substantial column shape, a plurality of cylindrical audio contacts made up of a tip contact, a first contact and second contact, a fixing element with two indention areas symmetrically formed at an outer surface thereof and spaced away from each other, and two isolated grounding contacts of arc shape. Each of the grounding contacts has an arc contact slice received in the indention area of the fixing element, conforming to an outer periphery of the fixing element. The tip contact, the first contact, the second contact, and the fixing element with the spaced grounding contacts attached thereto are arranged in turn and molded to fix to the insulating housing in once, forming as a single piece.

As described above, the fixing element has two spaced indention areas to receive the two isolated grounding contacts. When the audio plug is inserted into a jack, the two grounding contacts are functioned as two grounding ends and applied in the circuits formed between the audio plug and the jack, which improves the grounding property, and accordingly reduces the mixed wave in process of transmitting audio signals and prevents from signal distortion.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
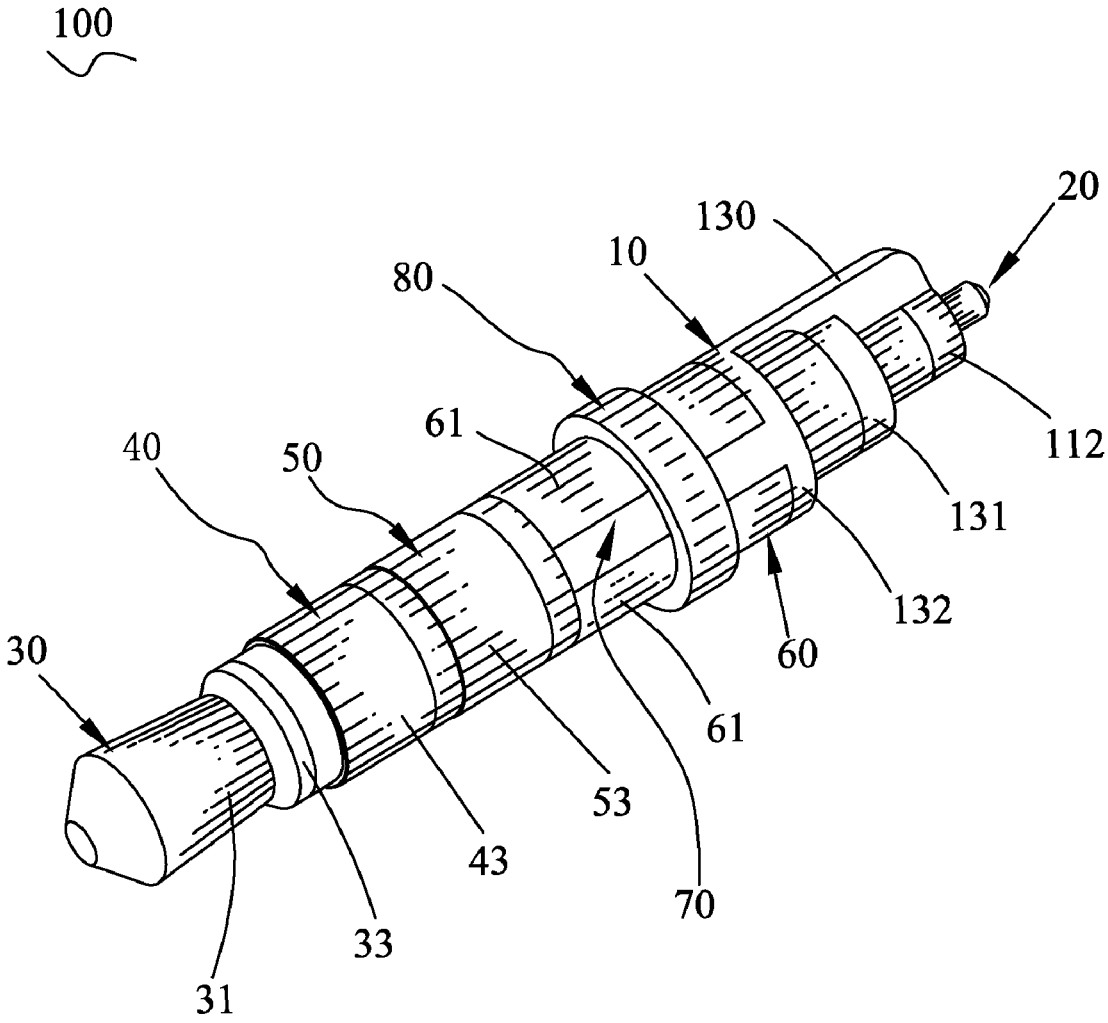
FIG. 1 is a perspective view of an audio plug of an embodiment in accordance with the present invention.
Figure 2:
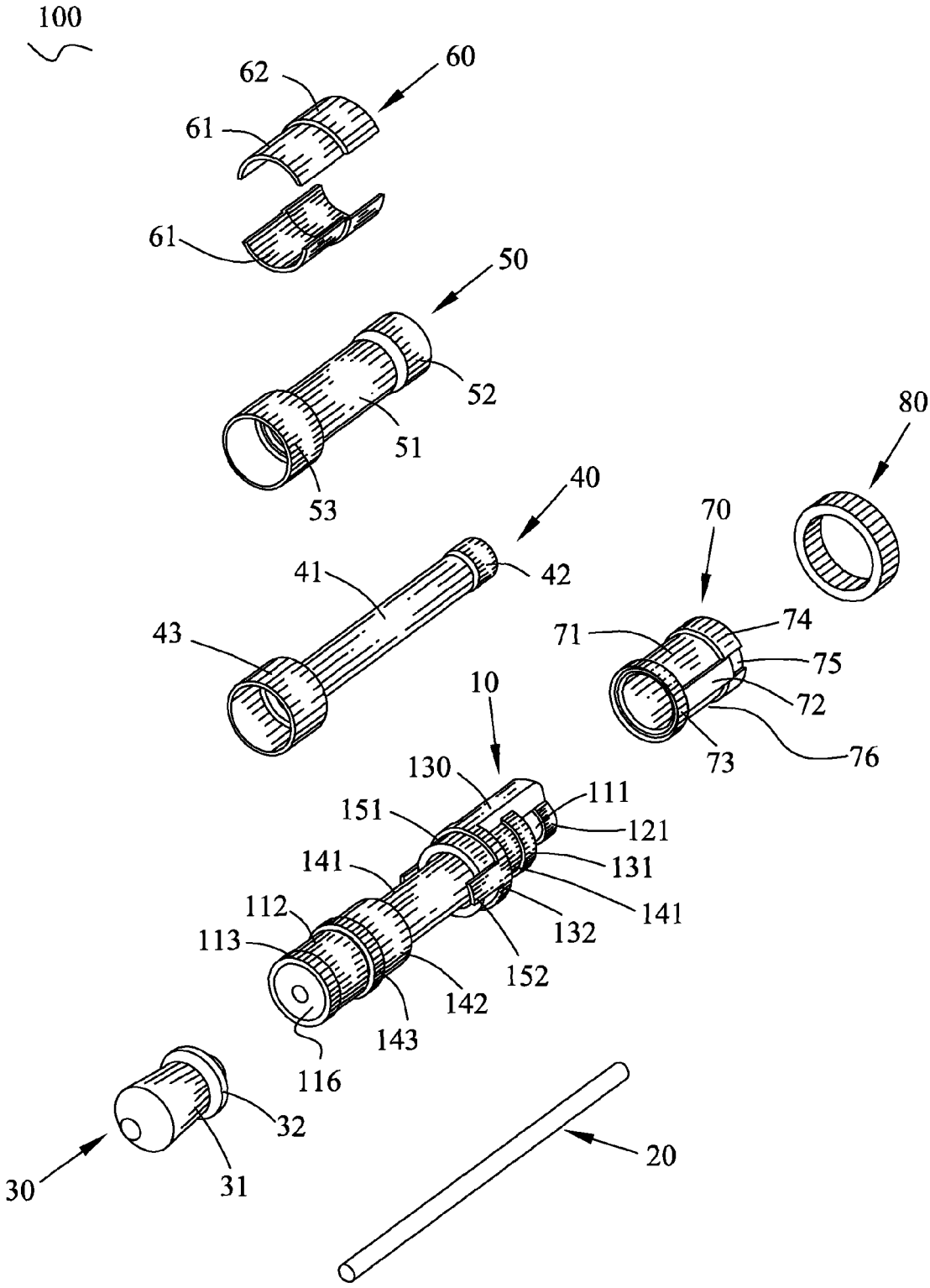
FIG. 2 is an exploded, perspective view of the audio plug shown in FIG. 1.

Referring to the drawings in greater detail, and first to FIGS. 1-2, the embodiment of the invention is shown as an audio plug 100. The audio plug 100 comprises an insulating housing 10, a tip contact 30, a first contact 40, a second contact 50, a pair of grounding contacts 60, and a fixing element 70.

Figure 3:
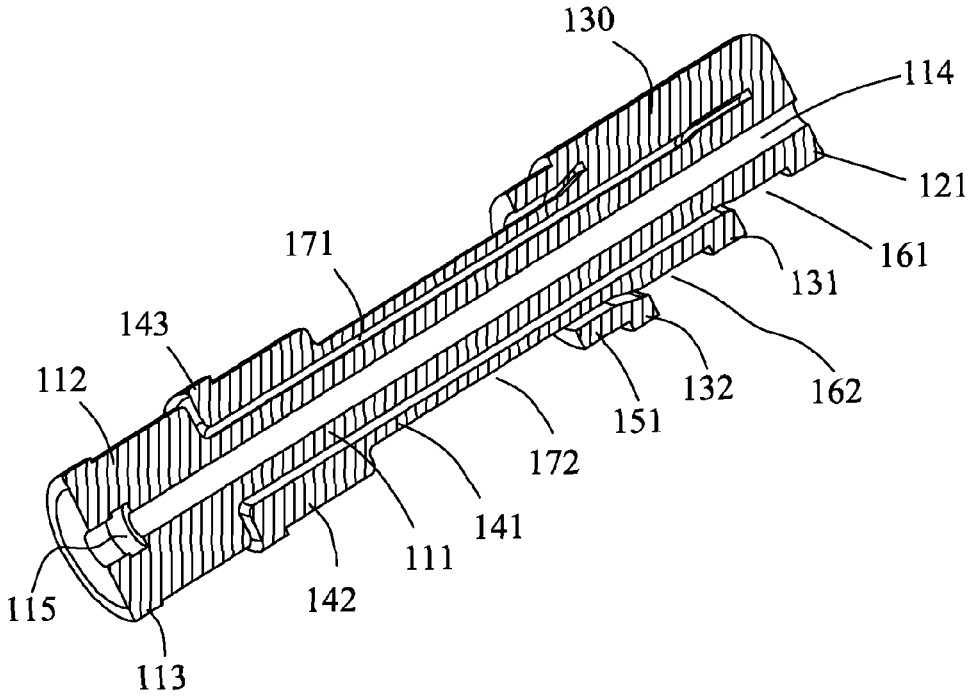
FIG. 3 is a cross-sectional view of an insulating housing of the audio plug shown in FIG. 2.

With reference to FIGS. 2-3, the insulating housing 10 has a body 111 of column shape. The body 111 has a center groove 114 extending along an axis thereof and defines a front end 116 which is firstly inserted into a mating jack (not shown). The center groove 114 has an inner side concaved radially to form a ladder recess 115 at a front end thereof. The front end 116 is protruded circumferentially to form a first flange 112 and a second flange 113 frontward of the first flange 112. The first flange 112 and the second flange 113 are both ring-shaped. The second flange 113 has an outer diameter larger than that of the first flange 112. A rear end of the body 111 is protruded circumferentially to form a blocking flange 121. The blocking flange 121 is ring-shaped. A connecting segment 130 is connected to a portion of an outer side of the blocking flange 121 and extends frontward.

The connecting segment 130 is spaced away from the body 111 and has a first connecting flange 131 adjacent to the blocking flange 121 and a second connecting flange 132 spaced away from the first connecting flange 131, with a second slot 162 formed therebetween. The first connecting flange 131 extends around the body 111 circumferentially and separately, and is spaced away from the blocking flange 121, with a first slot 161 formed therebetween. A front side of the first connecting flange 131 is prolonged frontward to form a first barrel 141. The first barrel 141 encircles and separates from the body 111 and the first flange 112, having an outer diameter smaller than that of the first connecting flange 131. A first receiving groove 171 is defined among the body 111, the first flange 112 and the first barrel 141, and communicates with the first opening 161. The second connecting flange 132 surrounds and is spaced away from the first barrel 141. A front side of the second connecting flange 132 is elongated frontward to form a second barrel 151 and two positioning strips 152 above the second barrel 151. The second barrel 151 encircles and separates from the first barrel 141, having an outer diameter smaller than that of the second connecting flange 132. The positioning strips 152 are symmetrically arranged and attached to an outer side of the second barrel 151 and extend frontward beyond the second barrel 151. A front end of the first barrel 141 is protruded circumferentially to form a ring-shaped first support 142 and a ring-shaped second support 143 frontward of the first support 142. The first support 142 is spaced away from the second barrel 151 with a long distance. The second support 143 has an outer diameter larger than that of the first support 142 and the first flange 112. A second receiving groove 172 is defined among the first support 142, the first barrel 141 and the second barrel 151, and communicates with the second slot 162.

Please refer to FIGS. 1-3, The first contact 40 is cylindrical and has a first tube 41. Two opposite ends of the first tube 41 are respectively connected with a second tube 42 and a third tube 43. The second tube 42 has a diameter larger that that of the first tube 41 and smaller than that of the third tube 43. The first tube 41 is received in the first receiving groove 171. The second tube 42 is located in the first slot 161 and exposes for being soldered with a corresponding cable (not shown). The third tube 43 wraps around first flange 112 and is restrained between the second flange 113 and the second support 143 for electrically connecting with terminals of the mating jack. The structure of the second contact 50 is analogous to that of the first contact 40 and comprises a first tube 51, a second tube 52 and a third tube 53. The first tube 51 is received in the second receiving groove 172 and surrounds the first barrel 141. The third tube 53 rings the first support 142 for electrically connecting with corresponding terminals of the mating jack. The second tube 52 is located in the second slot 162 and exposes for being soldered with a corresponding cable (not shown).

Figure 4:
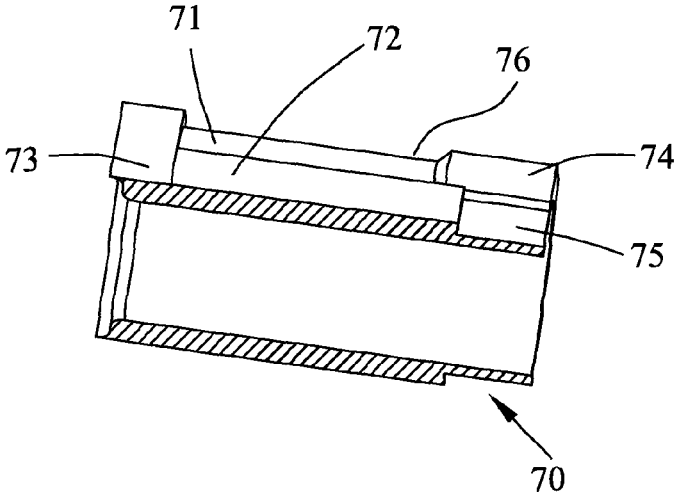
FIG. 4 is a cross-sectional view of a fixing element of the audio plug shown in FIG. 2.

Please refer to FIG. 2 and FIG. 4, the cylindrical fixing element 70 may be molded with plastic material and has a third barrel 71. The third barrel 71 wraps around the first tube 51 of the second contact 50. An outer surface of the third barrel 71 has two indention areas 76 disposed symmetrically and defines a front wall 73, a rear wall 74, and two stopping walls 72 extending frontward and rearwards to surround each indention area 76. The rear wall 74 has two symmetrical positioning recesses 75 in alignment with the respective stopping walls 72 for receiving the positioning strips 152. The grounding contact 60 has an arc contact slice 61 and an arc soldering slice 62. The soldering slice 62 is bent outwardly and radially from a rear end of the contact slice 61 and stretched rearwards. The soldering slice 62 has an arc radius larger than that of the contact slice 61, with a drop formed therebetween. The contact slice 61 is received in the indention area 76. The soldering slice 62 wraps around the rear wall 74 and the second barrel 151. A fixing ring 80 is molded to hoop connection parts between the contact slices 61 and the soldering slices 62 for fixing the grounding contacts 60 to the fixing element 70.

Figure 5:
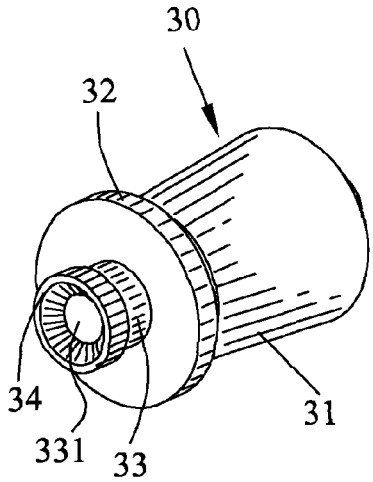
FIG. 5 is a perspective view of a tip contact of the audio plug shown in FIG. 2 seen from another angle.

Please refer to FIG. 2 and FIG. 5, the tip contact 30 has a contact end 31 of cylinder shape, with an outer diameter gradually decreasing from a front end to a rear end thereof, and a circular contact plate 32 connected with the rear end of the contact end 31. The contact plate 32 has an outer peripheral dimension substantially same as that of the second flange 113. A center of the contact plate 32 is projected opposite to the contact end 31 to form a positioning cylinder 33. The positioning cylinder 33 surrounds to form a positioning hole 331, and has a ring 34 connected with a rear end thereof. The ring 34 has an outer diameter larger than that of the positioning cylinder 33 to form an outer surface of ladder shape for engaging with the ladder recess 115. A conductive rod 20 is provided to connect with the tip contact 30. The conductive rod 20 is a thin and long rod, and received in the center groove 114, with a free end thereof inserted into the positioning hole 331 for realizing the electrical connection therebetween.

When the audio plug 100 is manufactured, the grounding contacts 60 are assembled to the fixing element 70. The conductive rod 20, the first contact 40, the second contact 50 and the fixing element 70 with the grounding contacts 60 attached thereto are arranged into a mold (not shown) by some assistant jigs (not shown) in accordance with the assembling process, and fixed together by the insulating housing 10 and the fixing ring 80, which are both formed by the means of injection molding in once, forming as a single piece. Herein, it should be noted that the manufacture process of the audio plug can be changed for meeting different demands and should not be limited.

As described above, the fixing element 70 has two spaced indention areas 76 to receive the two isolated grounding contacts 60. When the audio plug 100 is inserted into the jack, the two grounding contacts 60 are functioned as two grounding ends and applied in the circuits formed between the audio plug 100 and the jack, which improves the grounding property, and accordingly reduces the mixed wave in process of transmitting audio signals and prevents signal distortion.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio plug, comprising:

an insulating housing of substantial column shape;

a plurality of cylindrical audio contacts, the audio contacts comprising a tip contact, a first contact and second contact;

a cylindrical fixing element, two indention areas symmetrically formed at an outer surface of the fixing element and spaced away from each other; and two isolated grounding contacts of arc shape, each of the grounding contacts having an arc contact slice received in the indention area of the fixing element, conforming to an outer periphery of the fixing element, wherein the tip contact, the first contact, the second contact, and the fixing element with the spaced grounding contacts attached thereto are arranged in turn and molded to the insulating housing in once, forming as a single piece.

2. The audio plug as claimed in claim 1, wherein the contact slice has an end bent outwardly and radially and stretched along an opposite extending direction of the contact slice to form an arc soldering slice lay around a flange of the indention area away from the second contact.

3. The audio plug as claimed in claim 2, wherein the soldering slice extends beyond the fixing element and is attached to the insulating housing.

4. The audio plug as claimed in claim 1, wherein the grounding contacts are fixed to the fixing element by means of a fixing ring which is positioned at a connection between the contact slice and the soldering slice.

5. The audio plug as claimed in claim 1, wherein the fixing element defines a cylindrical barrel, the barrel has two stopping walls extending along an axis thereof to space the indention areas from each other, an end of the barrel away from the second contact has two symmetrical positioning recesses in alignment with the respective stopping walls, for engaging with corresponding positioning strips of the insulating housing.

* * * * *